US006280264B1

(12) United States Patent
Whipple et al.

(10) Patent No.: US 6,280,264 B1
(45) Date of Patent: Aug. 28, 2001

(54) TERMINAL CONNECTOR SECURING WIRE WITH A WIDE RANGE OF DIAMETERS TO A CONDUCTOR OF AN ELECTRIC POWER SWITCH AND AN ELECTRIC POWER SWITCH INCORPORATING THE TERMINAL CONNECTOR

(75) Inventors: Michael Jerome Whipple, Rochester; Edward Ethber Lias, Aliquippa, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/750,591

(22) Filed: Dec. 28, 2000

(51) Int. Cl.[7] ..... H01R 4/36
(52) U.S. Cl. ..... 439/814; 335/202
(58) Field of Search ..... 439/814, 813, 439/812, 810, 781, 782, 174, 166; 335/202

(56) References Cited

U.S. PATENT DOCUMENTS 2,777,119 * 1/1957 Edmunds ..... 439/814
2,885,654 * 5/1959 Norden ..... 439/814
4,457,577 * 7/1984 Browne et al. ..... 439/413
4,603,376 * 7/1986 Maier ..... 439/814
5,206,789 * 4/1993 Barbry ..... 335/202
6,084,188 * 7/2000 Mueller et al. ..... 439/814
6,211,759 * 4/2001 Little et al. ..... 335/202

* cited by examiner

*Primary Examiner*—Brian Sircus
*Assistant Examiner*—P K Dinh
(74) *Attorney, Agent, or Firm*—Martin J. Moran

(57) ABSTRACT

A terminal connector connects wire with a range of diameters to the conductor of an electrical power switch. The connector includes a collar with a laterally extending slot sized and shaped to receive the switch conductor. An aperture adjacent the slot is sized to accommodate the full range of wire diameters. A screw is threaded into a longitudinal tapped bore in the collar to clamp the wire to the conductor. The collar is reversible on the conductor for access to the screw for panel and DIN rail mounting of the power switch. A telescoping screw extends the range of wire sizes accommodated. The aperture is shaped to funnel wire diameters in the lower end of the range of diameters under an inner screw of the telescoping screw and into engagement with the switch conductor.

18 Claims, 5 Drawing Sheets

TERMINAL CONNECTOR SECURING WIRE WITH A WIDE RANGE OF DIAMETERS TO A CONDUCTOR OF AN ELECTRIC POWER SWITCH AND AN ELECTRIC POWER SWITCH INCORPORATING THE TERMINAL CONNECTOR

BACKGROUND OF THE INVENTION

1. Field of the Invention

This invention relates to a terminal connector for connecting wiring to switches used in electric power circuits, and particularly to such a terminal connector which can accommodate a wide range of wire sizes and alternate mounting configurations of the switches.

2. Background Information

Where electric power switches such as circuit breakers, transfer switches, contactors and the like are used in distribution systems having wires as the conductors, terminal connectors are needed to connect the wiring to the rigid, generally flat conductors of the switches. A common type of connector has a collar with a transverse slot engaging the flat conductor of the switch. An adjacent aperture receives the wire which is clamped against the flat conductor by a screw threaded into a longitudinal bore in the collar.

Depending upon the installation, or section of an installation, the size of the wire may vary over a wide range, e.g., from 14 AWG to 1/0. With wire at the lower end of the range of sizes, the installer must be careful to ensure that the wire is directly in line with the screw. Otherwise, a poor connection can result, such as where the smaller diameter wire lodges between the side of the screw and the edge of the aperture. Such a connection will not pass the required pull test in which the connection must support a designated weight for a prescribed time period.

For electric power switches with molded casings, the terminal connectors are typically disposed in pockets formed in the ends of the molded casing with the wires inserted laterally into the aperture in the terminal collar and with the screw accessible from the top face of the casing. Where the switches are mounted with the bottom face engaging rails, the screws are easily accessible for connecting and disconnecting the wiring. Currently, different terminal connectors are required when the switches are front mounted, that is, with the front face facing a panel so that the terminal screws are accessible from the bottom face of the switch. Otherwise, the switch cannot be wired while installed on the panel.

SUMMARY OF THE INVENTION

This invention is directed to an improved terminal connector and an electric power switch incorporating the improved terminal connector. The terminal connector, for use in connecting wire with a range of sizes to a flat conductor of an electric power switch, comprises a collar with a lateral slot sized and shaped for receiving the conductor of the switch. An aperture adjacent to and intersecting the slot is sized for receiving the full range of sizes of the wire. The collar also has a longitudinally extending tapped hole transverse to and intersecting the aperture. The terminal connector further includes a telescoping screw comprising an outer screw with an external thread threaded into the tapped hole of the collar and a tapped longitudinal bore. The telescoping screw also includes an inner screw threaded into the tapped longitudinal bore of the outer screw. The outer screw is advanced in the threaded hole in the collar to clamp the wire against the conductor of the switch with the inner screw being advanced toward the switch conductor beyond the outer screw when the wire is in the lower end of the range of diameters.

The aperture is shaped to cam the wire in the lower range of diameters into engagement with the flat conductor as the inner screw is advanced toward the flat conductor. Preferably, the aperture is at least partially circular, having a diameter complementary to that of the wire at the upper end of the range of diameters. More particularly, the aperture can have a circular section not intersecting the slot and a transition section extending between the circular section and the slot. This transition section can be a cylindrical passage axially aligned with the threaded bore in the collar and with a diameter complementary to the diameter of the inner screw. The inner screw may be provided with a beveled end extending toward the slot in the collar to form an annular gap with the cylindrical passage and the flat conductor having a cross section smaller than the diameter of the wire. The circular section of the aperture in the collar can be sized, for example, to receive a 1/0 wire at the upper end of the wire diameters and the annular gap can be sized smaller than a #14 wire at the lower end of the range of wire diameters. In addition, the collar can have a longitudinal hole extending to the slot and a fastener extending through this hole to secure the flat conductor in the slot of the collar.

The invention also embraces an electric power switch having a molded casing with a top face, a bottom face and an end face between the top and bottom faces with the end face having an elongated recess. A conductor of the switch projects from the molded case into the elongated recess. A reversible terminal for securing a wire to the switch conductor in the recess comprises a collar having a first aperture extending laterally in the collar and sized and shaped to receive the switch conductor. A second aperture extends laterally in the collar substantially parallel to and intersecting the first aperture. The first aperture is adjacent a first end of the collar through which a first axial bore extends to the first aperture. A first fastener extends through this first bore and engages the switch conductor to clamp the collar to the switch conductor. A second axial bore extends from the second end of the collar to the second aperture. A second fastener in the form of a screw threads into the second bore and clamps the wire inserted into the second aperture against the switch conductor to effect an electrical connection between the wire and the switch conductor. The collar and the recess in the molded housing are shaped for reversible mounting of the collar on the switch conductor with the second fastener selectively accessible through the recess from the top face of the molded casing and alternatively from the lower face. For installations where the wire can have a range of diameters, the screw can be the telescoping screw described above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to an electric power switch in a form of a two pole miniature circuit breaker. However, it will be clear to those skilled in the art that the invention has application to other types of electric power switches.

Figure 1:
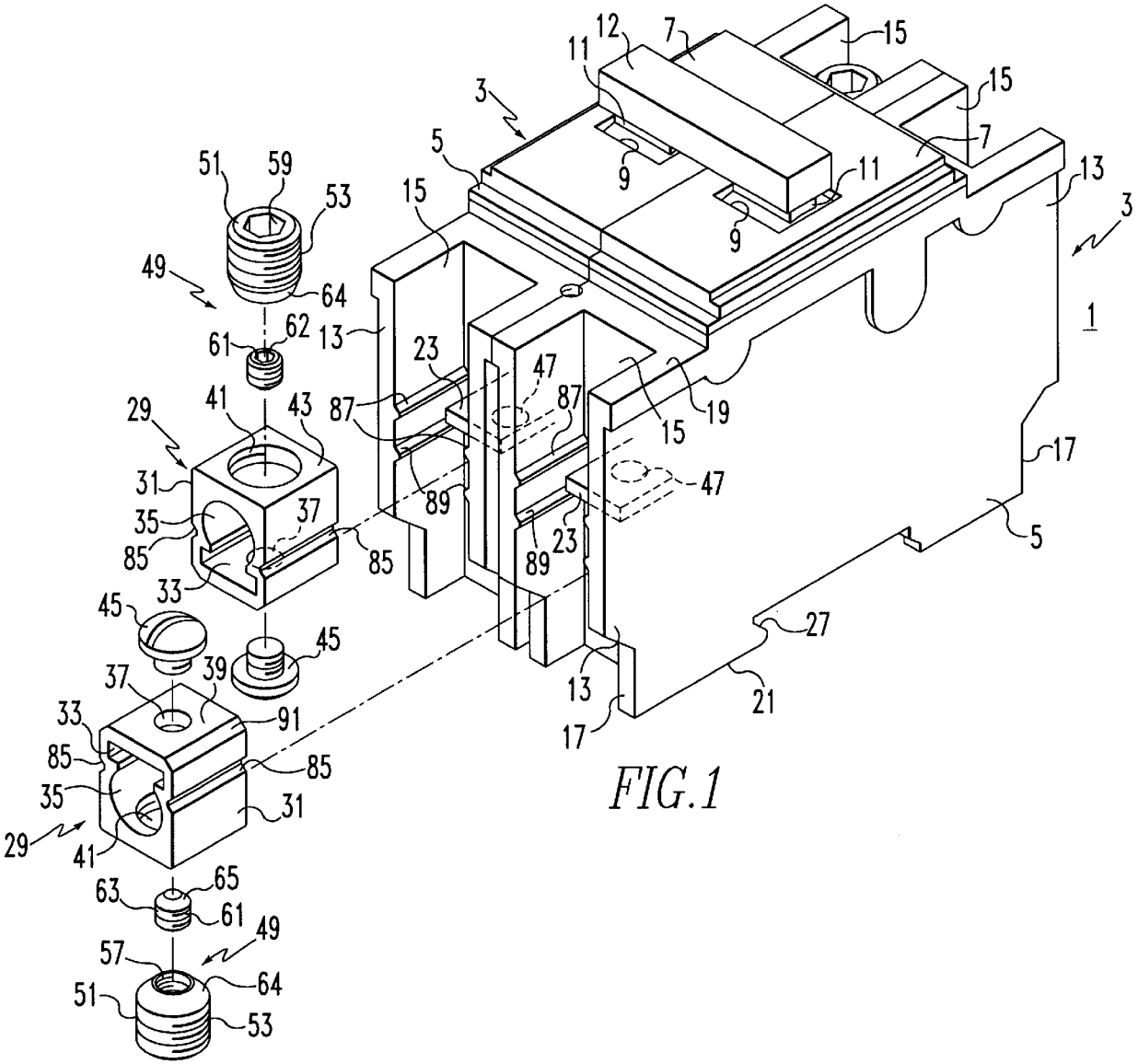
FIG. 1 is an exploded isometric view illustrating an electric power switch incorporating the invention.

Referring to FIG. 1, the exemplary electric power switch 1 is a two pole circuit breaker 1 comprising two single pole circuit breakers 3 secured together. Each single pole breaker has a molded case 5 which includes a raised escutcheon 7 with an opening 9 through which a handle 11 protrudes. The two handles are operated together by a handle tie 12. The molded cases 5 include extensions 13 at each end face 17 of the molded case 5 forming elongated recesses 15 extending between an upper face 19 and a lower face 21. Switch conductors 23, forming the main electrical path through the circuit breaker, project laterally into the recesses 15. In the exemplary circuit breakers 3, these conductors are flat, rigid conductors.

The two pole circuit breaker 1 can be mounted in two configurations as will be seen. For mounting inside a panel, a pair of nuts 25 are recessed in the upper face 19 of the casing 5 (see FIG. 5). The molded casing also includes a transverse groove 27 in the lower face 21 for mounting the two pole circuit breaker 1 to a standard DIN rail, as is well known.

Figure 2:
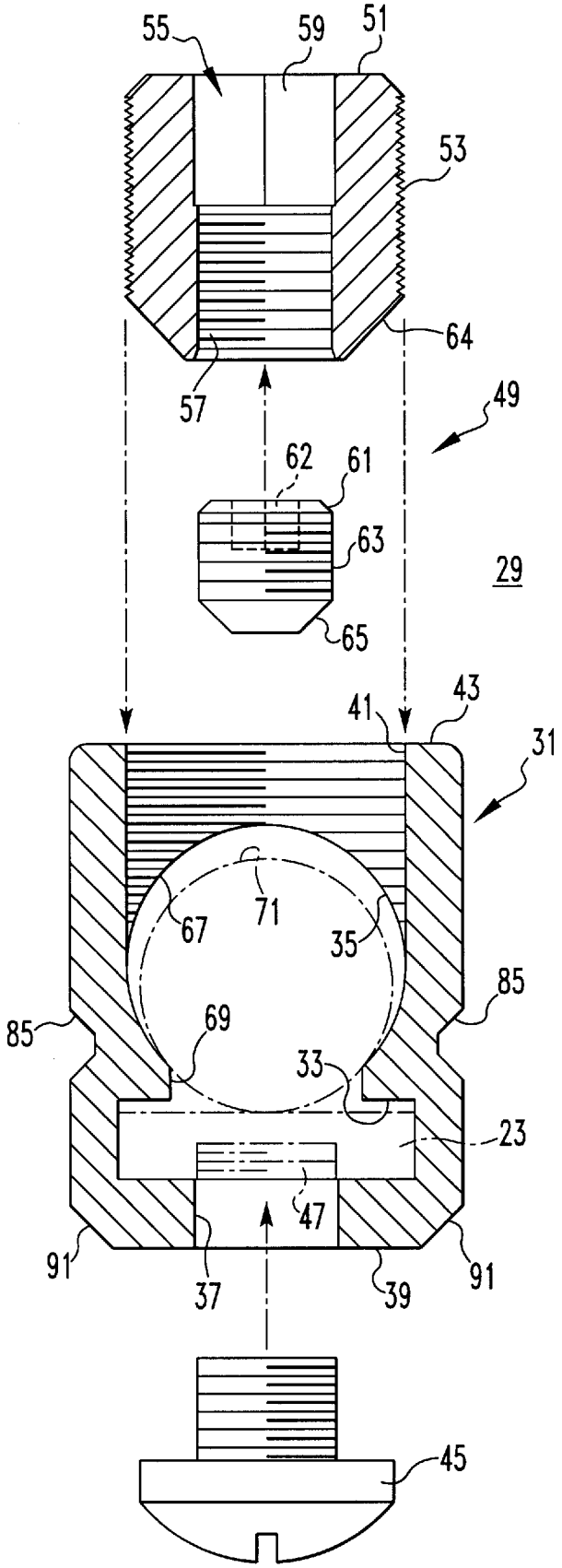
FIG. 2 is an exploded longitudinal sectional view of a terminal connector in accordance with the invention.

Terminal connectors 29 are provided for connecting external wiring to the flat conductors 23. Referring also to FIG. 2, the terminal connectors 29 each comprise a collar 31 having a slot 33 extending laterally there through. This slot 33 is sized and shaped to receive the switch conductor 23. An aperture 35 extends laterally in the collar adjacent to and intersecting the slot 33. This aperture is sized to receive the full range of diameters of wire to be connected to the switch conductor 23.

The collar has a first longitudinal hole 37 extending from a first end 39 of the collar and extending into the slot 33. The collar also has a second longitudinal tapped hole 41 extending from the second end 43 of the collar to the aperture 35. A fastener in the form of a screw 45 extends through the longitudinal hole 37 and engages a tapped hole 47 in the switch conductor 23. A second fastener in the form of telescoping screw 49 is threaded into the tapped longitudinal hole 41. In the embodiment of the invention illustrated in FIG. 2, the fastener 49 is a telescoping screw which includes an outer screw 51 having an external thread 53 which threads into the tapped hole 41. The outer screw 51 has a longitudinal bore 55 which is tapped at the lower end 57. The outer screw has a hexagonal socket 59 in its upper end concentric with the longitudinal bore for receiving an Allen wrench.

The telescoping screw 49 further includes an inner screw 61 having an external thread 63 which is threaded into the tapped section 57 of the longitudinal bore 55 in the outer screw 51 using an Allen wrench seated in hexagonal socket 62. The outer screw 51 and inner screw 61 are both chamfered 64 and 65, respectively at their lower ends.

The terminal connector 29 is sized and shaped to accommodate wire within a range of diameters. It is shaped to cam wires near the lower end of the range of diameters into engagement with the switch conductor which is received in the slot 33. The exemplary terminal connector is sized to accommodate wire diameters from 14 AWG to 1/0. Thus, the aperture 35 includes a circular section 67 having a diameter complementary to that of a 1/0 wire. The circular section 67 of the aperture 35 does not intersect the slot 33. Therefore, an intermediate or transition section 69 is included in the aperture 35 to connect the circular section 67 with the slot 33. This intermediate section 69 is cylindrical and has a diameter complementary to the diameter of the diameter of the inner screw 61.

Figure 3:
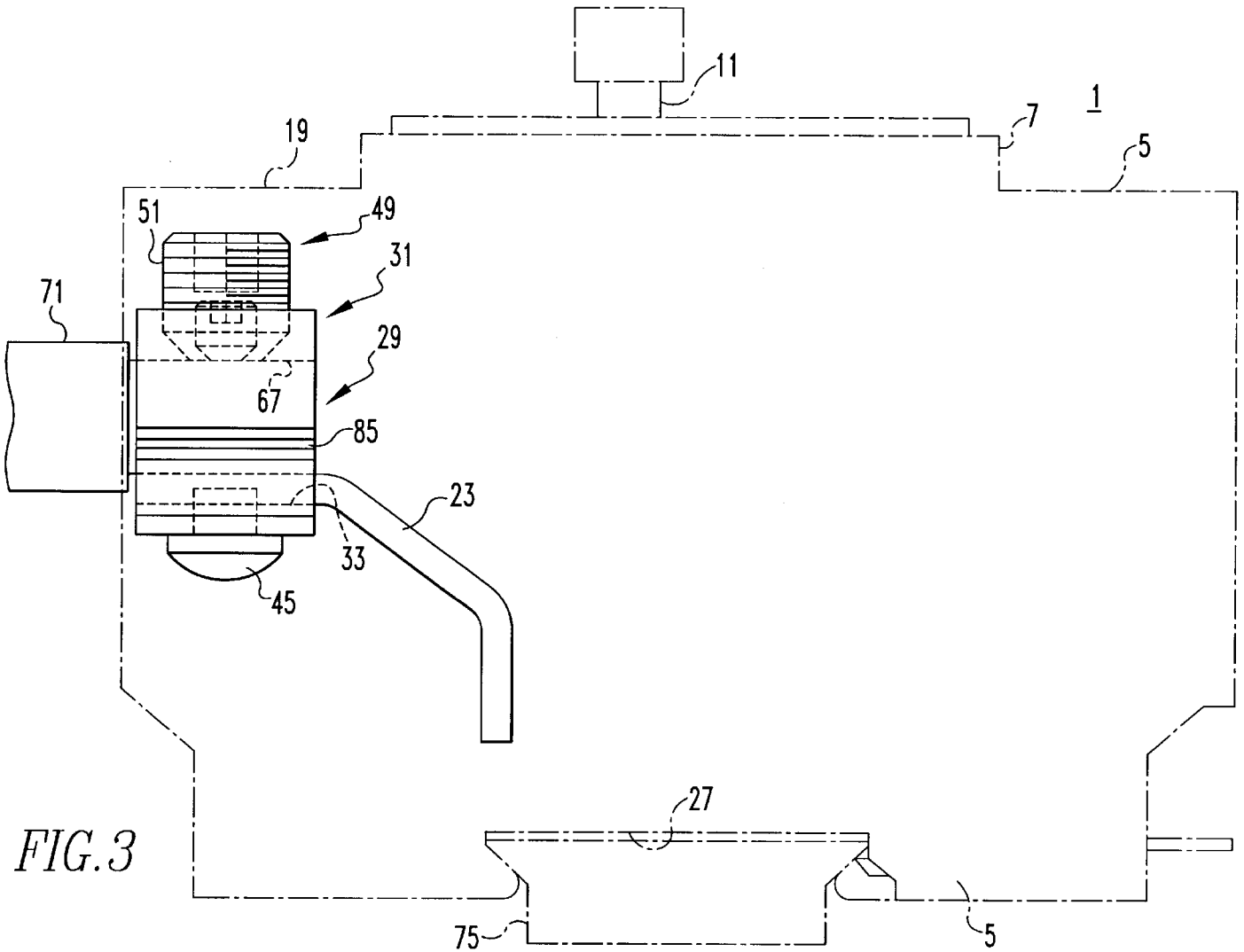
FIG. 3 is an elevation view of a terminal connector in combination with a DIN mounted circuit breaker (shown in phantom) in accordance with the invention, mounting the largest size wire to the conductor of the circuit breaker.
Figure 4:
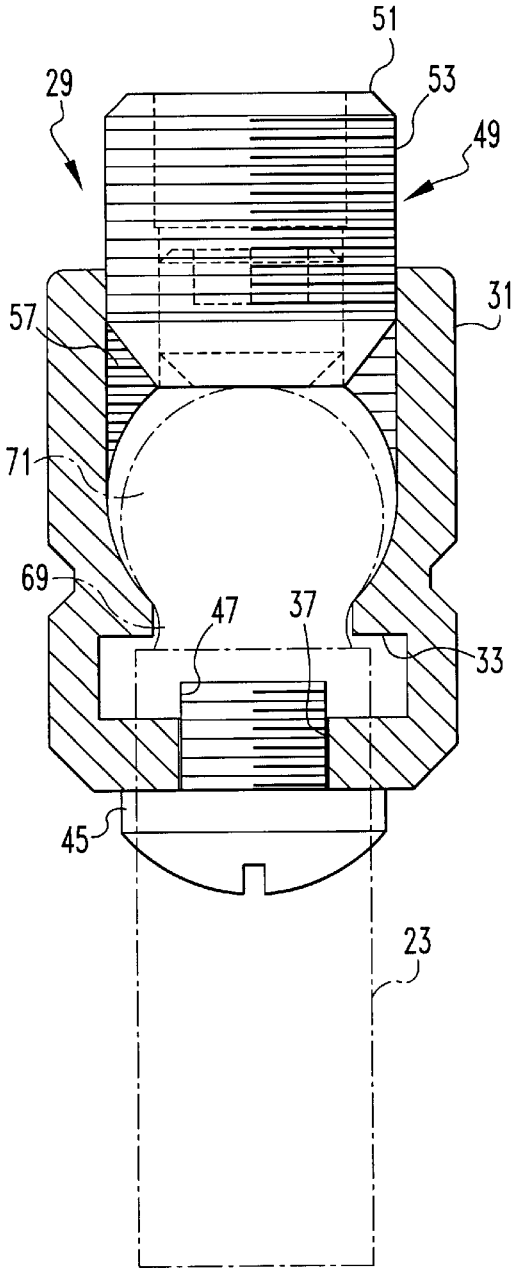
FIG. 4 is an elevation view of the terminal conductor as viewed from the right side in FIG. 3.

As can be seen from FIGS. 3 and 4, a wire 71 having a diameter at the upper range of diameters accommodated by the connector, substantially fills the circular section 67 of the aperture 35. The outer screw 51 is threaded into the tapped longitudinal hole 41 in the collar 31 to clamp the wire 71 against the switch conductor 23. The 1/0 wire is a braided wire which is easily deformed through the intermediate section 69 of the aperture 35 and spreads out to make substantial surface contact with the switch conductor 23.

The collar 31 is secured on the switch conductor 23 by engaging the slot 33 with the switch conductor 23 and then passing the fastener 45 through the longitudinal hole 37 in the bottom of the collar and threading it into the tapped hole 47 in the switch conductor 23.

Figure 6:
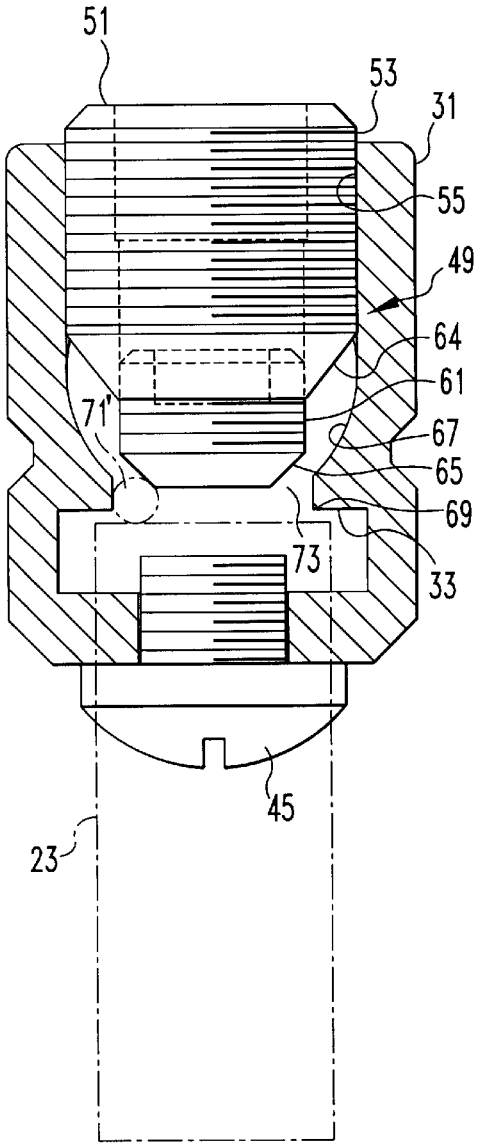
FIG. 6 is an elevation view of the terminal connector shown in FIG. 5 and as seen from the right side in FIG. 5.
Figure 5:
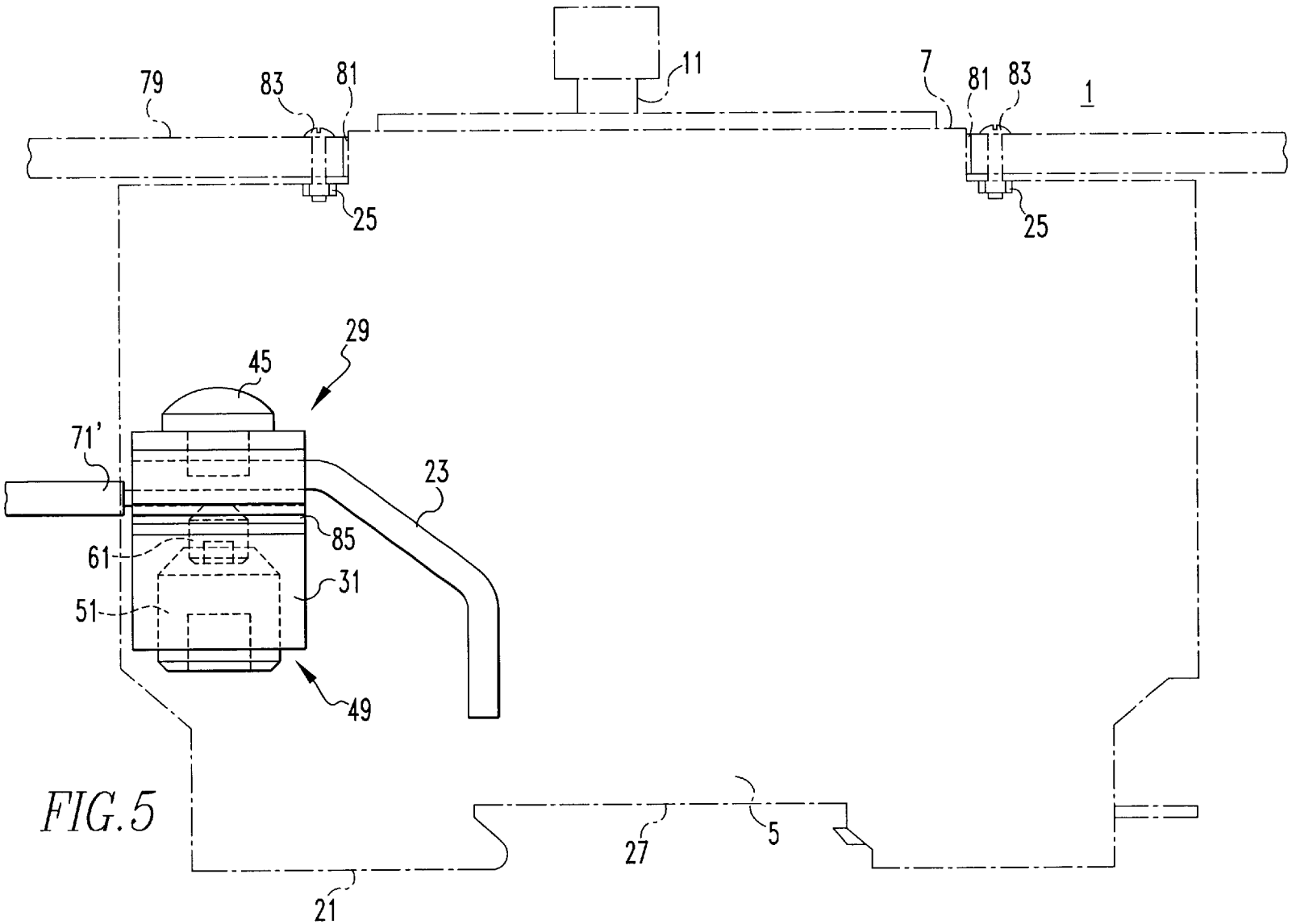
FIG. 5 is an elevation view of a terminal connector in combination with a panel mounted circuit breaker (shown in phantom) in accordance with the invention and shown connecting the smallest size wire to the circuit breaker.

As shown in FIGS. 5 and 6, when the wire 71' is at the lower end of the range of wire diameters, the outer screw is threaded down in the threaded longitudinal hole 41 in the collar and then the inner screw 61 is threaded down in the tapped bore 55 in the outer screw to extend toward the terminal connector 29. The dimensions of the circular section 67 and the intermediate section 69 of the aperture 35 are such that as the telescoping screw 49 is threaded inward, the wire 71' is cammed toward the switch conductor 23. As can be seen in FIG. 6, the chamfer 65 on the inner screw 61 forms an annular gap 73 which has a cross section smaller than the diameter of the wire 71' so that whether the wire 71' is centered under the inner screw 61, or becomes clamped in the annular gap 73 and makes good electrical contact with the terminal connector 29. While the range of wire diameters in the exemplary connector was 14 AWG to 1/0, other ranges of wire diameters can be similarly accommodated.

As another aspect of the invention, the terminal connector 29 can be reversibly mounted on the switch conductor 23. For instance, as shown in FIG. 3, where the circuit breaker 1 is mounted on a DIN rail 75, the terminal connector can be inserted in the recess 15 with the telescoping screw 49 facing upward and therefore accessible from the upper face 19 of the circuit breaker 1 while the circuit breaker is mounted on the rail 75 received in slot 27 in the molded housing. In this instance, the connector would be mounted on the switch conductor 23 using the fastener 45 before the circuit breaker is mounted on the rail.

In an alternate arrangement, as shown in FIG. 5 where the circuit breaker is panel mounted behind a panel 79 having an opening 81 through which the escutcheon 7 and handle 11 protrude by screws 83 which extend through the panel and gauge the nuts 25 in the molded case 5. It can be appreciated, that when so mounted, wiring could not be connected or disconnected using the terminal connector 29 if it were mounted in the same orientation as in FIG. 3. Therefore, for panel mounted circuit breakers the position of the terminal connector 29 is reversed so that the wire 71' is connected below the switch conductor 23 and the telescoping screw 49 faces downward for access from the lower face or rear face 21 of the circuit breaker.

To assist in aligning the slot 33 in the terminal connector 29 with the switch conductor 23, the collar 31 and the recess 15 in the molded case 5 are keyed. For this purpose, the collar 29 is provided with a pair of transverse grooves 85 which engage either of two pairs 87 and 89 of ribs molded into the recesses 15. When the grooves 85 in the collar 31 are aligned with the first pair of ribs 87, the terminal connector 29 is positioned as shown in FIG. 3 with the telescoping screw accessible from the upper face 19 of the circuit breaker 1. On the other hand, the terminal connector 29 must be turned upside down to align the slot 33 with the switch conductor 23 when the grooves 85 are aligned with the second pair of ribs 89 to mount the terminal connector as shown in FIG. 5. A chamfer 91 on the collar accommodates the rib 87 or 89 not engaged by the groove 85. Alternatively, ribs can be provided on the collar and grooves can be molded into the recesses.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A terminal connector for connecting a wire within a range of diameters to a conductor of an electric power switch; the terminal connector comprising:

a collar having a slot extending laterally in the collar and sized to receive the conductor, an aperture extending laterally in the collar adjacent to and intersecting the slot and sized to receive the full range of diameters of wire, and a longitudinally extending tapped hole transverse to and intersecting the aperture; and a telescoping screw comprising an outer screw having an external thread threaded into the tapped hole in the collar and having a tapped longitudinal bore, and an inner screw having an external thread which threads into the tapped longitudinal bore of the outer screw, the outer screw being advanced in the tapped hole to clamp the wire against the conductor with the inner screw being advanced toward the conductor beyond the outer screw when the wire is in a lower end of the range of diameters.

2. The terminal connector of claim 1 wherein the aperture is shaped to funnel wire in a lower end of the range of diameters under the inner screw and into engagement with the conductor as the inner screw is advanced toward the conductor.

3. The terminal connector of claim 2 wherein the aperture is at least partially circular, having a diameter complementary to the wire at the upper end of the range of diameters.

4. The terminal connector of claim 3 wherein the conductor is flat and the aperture has a circular section not intersecting the slot and an intermediate section extending between the circular section and the slot.

5. The terminal connector of claim 4 wherein the circular section of the aperture has a diameter complementary to 1/0 wire at the upper end of the range of diameters.

6. The terminal connector of claim 4 wherein the transition section is a cylindrical passage with a diameter complementary to a diameter of the inner screw and axially aligned with the tapped bore.

7. The terminal connector of claim 6 wherein the inner screw has a chamfered end extending toward the slot forming an annular gap with the cylindrical passage and the flat conductor with a cross section smaller than the diameter of the wire at the lower end of the range of diameters.

8. The terminal connector of claim 7 wherein the circular section is sized for receiving a 1/0 wire at the upper end of the range of diameters and the annular gap is sized to have a cross section smaller than the diameter of a #14 wire at the low end of the range of diameters.

9. The terminal connector of claim 8 wherein the collar has a longitudinal hole extending to the slot and a fastener extending through the longitudinal hole and engaging the flat conductor to secure the flat conductor in the slot.

10. The terminal connector of claim 1 wherein the collar has a longitudinal hole extending to the slot and a fastener extending through the longitudinal hole and engaging the conductor to secure the conductor in the slot.

11. An electric power switch comprising:

a molded casing with an upper face, a lower face and an end face extending between the upper face and the lower face and an elongated recess in the end face;

a switch conductor projecting from the molded case into the elongated recess; and a reversible terminal connector for securing a wire to the switch conductor in the elongated recess and comprising a collar having a slot extending laterally and sized for receiving the switch conductor, an aperture extending laterally in the collar adjacent to and intersecting the slot, the slot being adjacent a first end of the collar and the aperture being adjacent a second end of the collar, the collar having a first longitudinal hole extending from the first end to the slot and a second longitudinal tapped hole extending from the second end of the collar to the aperture, a fastener extending through the first longitudinal hole engaging the switch conductor to clamp the collar to the switch conductor and a second fastener in the form of a screw which threads into the second longitudinal hole and clamps the wire inserted into the aperture against the switch conductor to effect an electrical connection between the wire and the switch conductor, the collar and the elongated recess being shaped such that the collar can be reversibly clamped to the switch conductor with the second fastener selectively accessible through the elongated recess from the upper face of the molded case and alternatively, from the lower face of the molded case.

12. The electric power switch of claim 11 adapted for wire having a selected diameter within a range of diameters, wherein the screw comprises an outer screw with an external thread threaded into the second longitudinal tapped hole in the collar and with a tapped longitudinal bore, and an inner screw threaded into the tapped bore of the outer screw, the outer screw being advanced toward the switch conductor to clamp the wire against the switch conductor and with the inner screw being advanced toward the switch conductor beyond the outer screw when the selected diameter of the wire is in a low end of the range of diameters, the aperture being shaped to funnel the wire under the inner screw and into engagement with the switch conductor as the inner screw is advanced toward the switch conductor.

13. The electric power switch of claim 12 wherein the aperture has a circular section not intersecting the slot and having a diameter complementary to the wire at the upper end of the range of diameters, and a transition section extending between the circular section and the slot.

14. The electric power switch of claim 13 wherein the transition section is a cylindrical passage having a diameter complementary to the diameter of the inner screw.

15. The electric power switch of claim 14 wherein the switch conductor is a flat conductor and the inner screw has a chamfered end extending toward the slot to form an annular gap with the cylindrical passage and the flat conductor, the annular gap having a cross section smaller than the diameter of the wire.

16. The electric power switch of claim 11 wherein the switch conductor is flat and the slot is generally rectangular.

17. The electric power switch of claim 11 wherein the collar and elongated recess are keyed for aligning the slot in the collar with the switch conductor, for reversibly clamping the collar to the switch conductor.

18. The electric power switch of claim 17 wherein one of the elongated recess and the collar has one of a rib and a groove and the other of the collar and recess has two of the other of the rib and groove to align the slot in the collar with the switch conductor for reversibly clamping the collar to the switch conductor.

* * * * *